US011238797B2

(12) United States Patent
Li et al.

(10) Patent No.: US 11,238,797 B2
(45) Date of Patent: Feb. 1, 2022

(54) PIXEL DRIVING METHOD, PIXEL DRIVING DEVICE AND DISPLAY DEVICE

(71) Applicant: BOE TECHNOLOGY GROUP CO., LTD., Beijing (CN)

(72) Inventors: Yongqian Li, Beijing (CN); Zhongyuan Wu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 12 days.

(21) Appl. No.: 16/622,562

(22) PCT Filed: Sep. 27, 2018

(86) PCT No.: PCT/CN2018/107892
§ 371 (c)(1),
(2) Date: Dec. 13, 2019

(87) PCT Pub. No.: WO2019/076186
PCT Pub. Date: Apr. 25, 2019

(65) Prior Publication Data

US 2021/0150986 A1 May 20, 2021

(30) Foreign Application Priority Data

Oct. 17, 2017 (CN) ..... 201710963964.X

(51) Int. Cl.
*G09G 3/3258* (2016.01)
*G09G 3/3291* (2016.01)

(52) U.S. Cl.
CPC ..... *G09G 3/3258* (2013.01); *G09G 3/3291* (2013.01); *G09G 2300/0465* (2013.01); *G09G 2300/0842* (2013.01)

(58) Field of Classification Search
CPC ..... G09G 3/3258; G09G 3/3291; G09G 2300/0465; G09G 2300/0842
See application file for complete search history.

(56) References Cited

U.S. PATENT DOCUMENTS

2002/0057234 A1 5/2002 Ishizuka et al.
2006/0108937 A1 5/2006 Kim
(Continued)

FOREIGN PATENT DOCUMENTS

CN 1773594 A 5/2006
CN 101097686 A 1/2008
(Continued)

OTHER PUBLICATIONS

First Office Action dated Feb. 28, 2019 for application No. CN201710963964.X with English translation attached.
(Continued)

*Primary Examiner* — Roberto W Flores
(74) *Attorney, Agent, or Firm* — Nath, Goldberg & Meyer; Joshua B. Goldberg

(57) ABSTRACT

The application provides a pixel driving method, a pixel driving device and a display device. The method includes steps of: obtaining a brightness sum of a frame according to a brightness of each of pixels in the frame; inquiring a data voltage compensation value corresponding to the obtained brightness sum from a preset first correspondence relationship, the first correspondence relationship including a one-to-one correspondence relationship between the brightness sum and the data voltage compensation value for one frame; compensating a data voltage of the frame according to the data voltage compensation value to generate a compensated data voltage; and outputting the compensated data voltage to a display panel.

13 Claims, 4 Drawing Sheets

(56) References Cited

U.S. PATENT DOCUMENTS

| | | | | |
|---|---|---|---|---|
| 2008/0007494 | A1 | 1/2008 | Kim et al. | |
| 2009/0002400 | A1* | 1/2009 | Ha | G09G 5/10 345/690 |
| 2009/0058772 | A1 | 3/2009 | Lee | |
| 2011/0157152 | A1 | 6/2011 | Byun | |
| 2013/0141469 | A1* | 6/2013 | Xu | G09G 3/3233 345/690 |
| 2013/0271502 | A1* | 10/2013 | Choi | G09G 3/3208 345/690 |
| 2014/0152642 | A1* | 6/2014 | Kim | G09G 3/3208 345/212 |
| 2016/0372066 | A1 | 12/2016 | Hou | |

FOREIGN PATENT DOCUMENTS

| | | | |
|---|---|---|---|
| CN | 102110409 | A | 6/2011 |
| CN | 104992690 | A | 10/2015 |
| CN | 104317085 | B | 1/2017 |
| CN | 107180613 | A | 9/2017 |
| CN | 107578746 | A | 1/2018 |
| KR | 20160056058 | A | 5/2016 |

OTHER PUBLICATIONS

Office Action dated Jun. 25, 2021 for application No. IN 201927052683.
Extended European Search Report dated May 20, 2021 for application No. EP 18868286.8.

* cited by examiner

PIXEL DRIVING METHOD, PIXEL DRIVING DEVICE AND DISPLAY DEVICE

CROSS REFERENCE TO RELATED APPLICATION

This is a National Phase Application filed under 35 U.S.C. 371 as a national stage of PCT/CN2018/107892, filed on Sep. 27, 2018, an application claiming the benefits of Chinese Patent Application No. 201710963964.X, filed on Oct. 17, 2017 in the China National Intellectual Property Administration, the contents of which are incorporated herein by reference in the entirety.

TECHNICAL FIELD

The present application relates to the field of display technology, and in particular, to a pixel driving method, a pixel driving device, and a display device.

BACKGROUND

An organic light-emitting diode (OLED) display device is a display screen made with organic electroluminescent diodes. Since the OLED display device includes self-luminous OLEDs and has the excellent characteristics of not requiring backlight source, high contrast, thin thickness, wide viewing angle, fast response speed, applicability to flexible panels, wide operating temperature range, simple structure and process, and the like all together, the OLED display device is considered as the next generation of flat panel display technology.

The OLED display device may have a pixel external compensation driving circuit, and display a picture under the driving and compensation of the pixel external compensation driving circuit, and light is emitted throughout the picture during the compensation time except for the sensing row. In the process of switching the picture of the display device, especially in the process of circularly switching between pictures with a large gray scale difference, such as black and white pictures, due to power supply interference, TFT hysteresis, poor light stability and the like, the sensing voltages on the sense lines generated by charging the sense lines through the driving thin film transistors (TFTs) under the driving of the same data voltage are nonuniform, resulting in mura in the displayed picture.

SUMMARY

The present disclosure provides a pixel driving method, a pixel driving device and a display device for avoiding mura of a displayed picture.

In one aspect, the present disclosure provides a pixel driving method including steps of: obtaining a brightness sum of a frame of picture according to a brightness of each of pixels in the frame of picture; inquiring a data voltage compensation value corresponding to the obtained brightness sum from a first correspondence relationship, the first correspondence relationship including a one-to-one correspondence relationship between the brightness sum and the data voltage compensation value for one frame of picture; compensating a data voltage of the frame of picture according to the data voltage compensation value to generate a compensated data voltage; and outputting the compensated data voltage to a display panel.

In some embodiments, before the step of obtaining a brightness sum of a frame of picture according to a brightness of each of pixels in the frame of picture, the method further includes steps of: establishing a second correspondence relationship, the second correspondence relationship including a one-to-one correspondence relationship between the brightness sum of a frame of picture and a voltage difference average value of pixels for one frame of picture, and the voltage difference average value being an average value of sensing voltages of all or a part of the pixels in the frame of picture; establishing a third correspondence relationship, the third correspondence relationship including a one-to-one correspondence relationship between the voltage difference average value of pixels and the data voltage compensation value for one frame of picture; and generating the first correspondence relationship according to the second correspondence relationship and the third correspondence relationship.

In some embodiments, the average value of the sensing voltages of the part of the pixels for one frame of picture is an average value of the sensing voltages of the pixels in a set number of rows in the one frame of picture.

In some embodiments, before the step of obtaining a brightness sum of a frame of picture according to a brightness of each of pixels in the frame of picture, the method further includes a step of: generating the brightness of each of the pixels in the frame of picture according to a data voltage of the pixel.

In some embodiments, the step of compensating a data voltage according to the data voltage compensation value to generate a compensated data voltage includes: compensating the data voltage of the pixels in a sensing row of the frame of picture according to the data voltage compensation value. The step of outputting the compensated data voltage to a display panel includes: outputting the compensated data voltage to the pixels in the sensing row of the display panel.

In some embodiments, the step of compensating a data voltage of the frame of picture according to the data voltage compensation value to generate a compensated data voltage includes: compensating the data voltage of all the pixels in the frame of picture according to the data voltage compensation value. The step of outputting the compensated data voltage to a display panel includes: outputting the compensated data voltage to all the pixels in the display panel.

In another aspect, the present disclosure provides a pixel driving device including: a memory; and a processor coupled to the memory. The memory stores computer-executable instructions for causing the processor to: obtain a brightness sum of a frame of picture according to a brightness of each of pixels in the frame of picture; inquire a data voltage compensation value corresponding to the obtained brightness sum from a first correspondence relationship, the first correspondence relationship including a one-to-one correspondence relationship between the brightness sum and the data voltage compensation value for one frame of picture; compensate a data voltage of the frame of picture according to the data voltage compensation value to generate a compensated data voltage; and output the compensated data voltage to a display panel.

In some embodiments, the computer-executable instructions cause the processor to: establish a second correspondence relationship, the second correspondence relationship including a one-to-one correspondence relationship between the brightness sum and a voltage difference average value of pixels for one frame of picture, and the voltage difference average value being an average value of sensing voltages of all or a part of the pixels in the frame of picture: establish a third correspondence relationship, the third correspondence relationship including a one-to-one correspondence relationship between the voltage difference average value of the pixels and the data voltage compensation value for one frame of picture; and generate the first correspondence relationship according to the second correspondence relationship and the third correspondence relationship.

In some embodiments, the average value of the sensing voltages of the part of the pixels in the frame of picture is an average value of the sensing voltages of the pixels in a set number of rows in the one frame of picture.

In some embodiments, the computer-executable instructions cause the processor to: generate the brightness of each of the pixels in the frame of picture according to a data voltage of the pixel, before obtaining the brightness sum of the frame of picture according to the brightness of each of pixels in the frame of picture.

In another aspect, the present disclosure provides a display device including a display panel and the above-described pixel driving device.

DETAILED DESCRIPTION

In order to make those skilled in the art better understand the technical solutions of the present disclosure, a pixel driving method, a pixel driving device and a display device according to the present disclosure will be further described in detail below in conjunction with the accompanying drawings.

Figure 1:
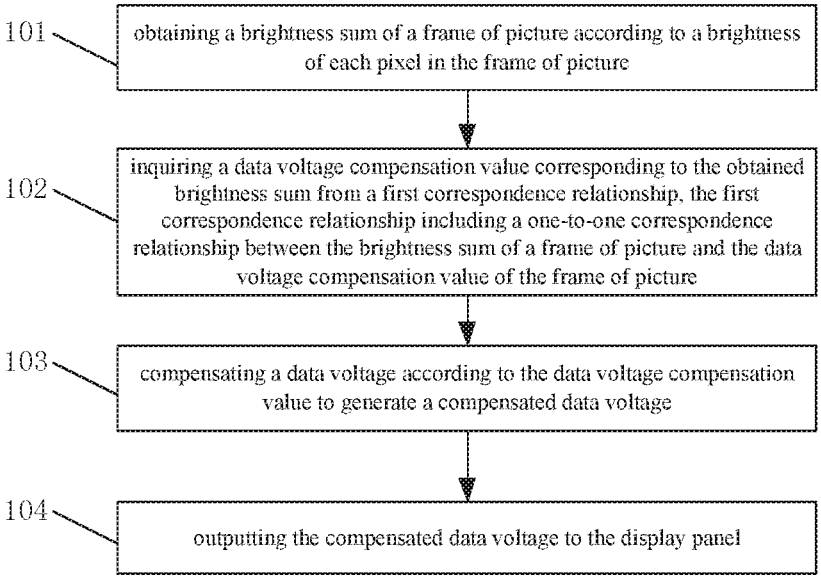
FIG. 1 is a flow chart of a pixel driving method according to an embodiment of the present disclosure.

FIG. 1 is a flow chart of a pixel driving method according to an embodiment of the present disclosure. As shown in FIG. 1, the method includes steps 101 to 104.

In step 101, a brightness sum of a frame of picture is obtained according to a brightness of each pixel in the frame of picture. For example, the brightnesses of all pixels in the frame of picture are added together to obtain the brightness sum of the frame of picture.

In step 102, a data voltage compensation value corresponding to the obtained brightness sum is inquired from a first correspondence relationship, the first correspondence relationship including a one-to-one correspondence relationship between the brightness sum of a frame of picture and the data voltage compensation value of the frame of picture. That is, in the first correspondence relationship, one value of the brightness sum of a frame of picture is associated with one data voltage compensation value of the frame of picture. In some embodiments, the first correspondence relationship may be preset.

In step 103, a data voltage is compensated according to the data voltage compensation value to generate a compensated data voltage. In some embodiments, the data voltage of each pixel of the frame of picture is compensated according to the data voltage compensation value.

In step 104, the compensated data voltage is output to the display panel.

In the pixel driving method according to the embodiments of the present disclosure, the data voltage compensation value corresponding to the brightness sum of a frame of picture is inquired according to the brightness sum, a data voltage of each pixel of the frame of picture is compensated according to the data voltage compensation value to generate a compensated data voltage, and the compensated data voltage is output to a display panel. By doing so, the sensing voltages under the driving of the compensated data voltage are uniform, thereby avoiding the mura on the displayed picture.

Figure 2:
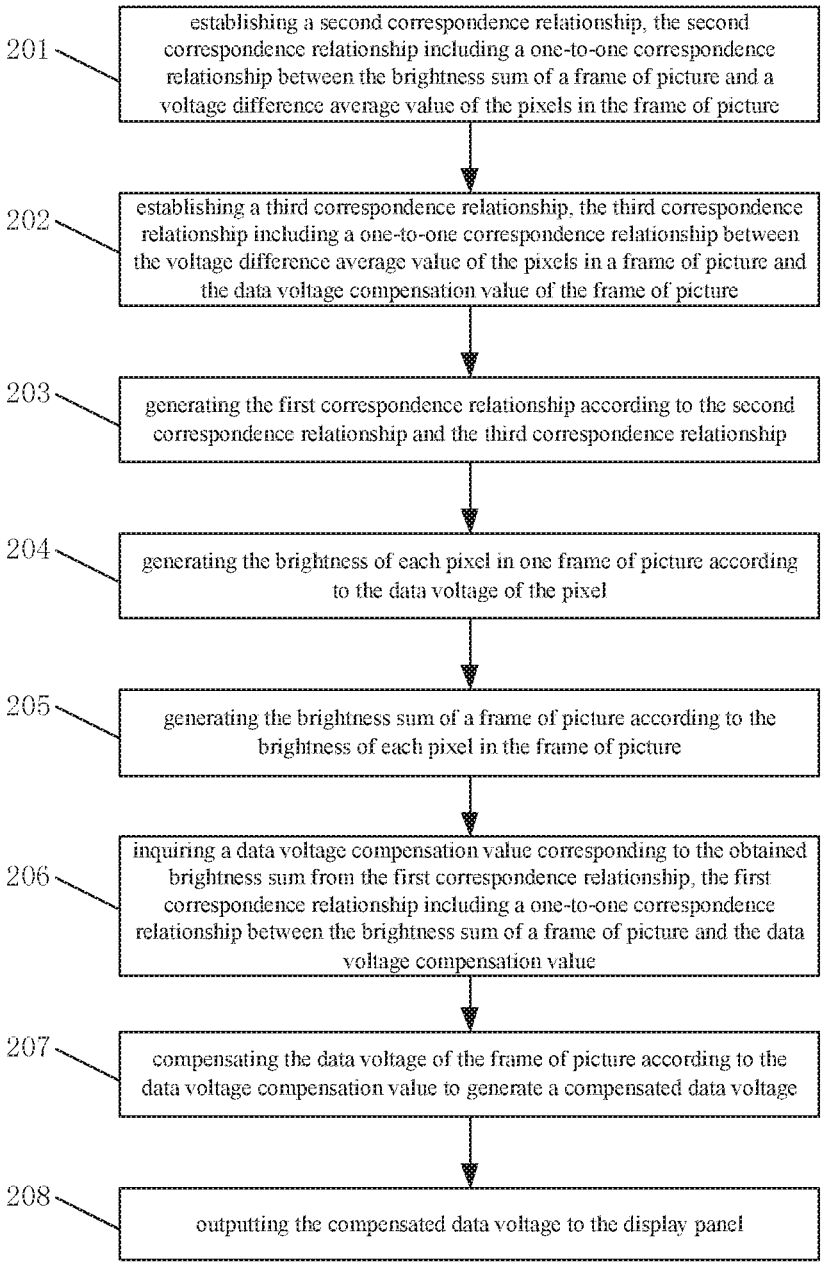
FIG. 2 is a flow chart of a pixel driving method according to an embodiment of the present disclosure.

FIG. 2 is a flow chart of a pixel driving method according to an embodiment of the present disclosure. As shown in FIG. 2, the method includes steps 201 to 208.

In step 201, a second correspondence relationship is established, the second correspondence relationship including a one-to-one correspondence relationship between the brightness sum of a frame of picture and a voltage difference average value of the pixels in the frame of picture. That is, in the second correspondence relationship, one value of the brightness sum of a frame of picture is associated with the voltage difference average value of the pixels in the frame of picture. The voltage difference average value may be an average value of sensing voltages of pixels of interest (e.g., a part of pixels or all pixels) in the frame of picture.

Figure 3:
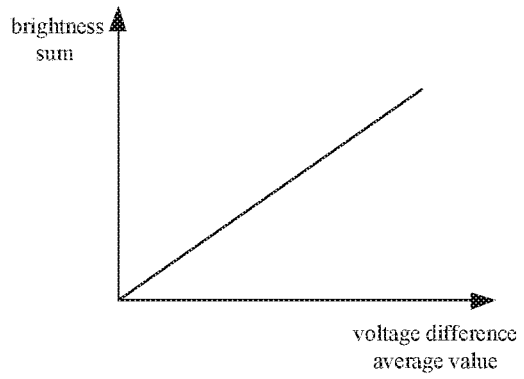
FIG. 3 is a diagram illustrating a second correspondence relationship in the method shown in FIG. 2.

In some embodiments, the second correspondence relationship may be implemented as a second display look-up table (LUT). FIG. 3 is a diagram illustrating the second correspondence relationship. As shown in FIG. 3, the abscissa represents the voltage difference average value, the ordinate represents the brightness sum, and each point on the curve shows the correspondence relationship between one value of the brightness sum and one voltage difference average value associated therewith. It can be seen that there is a linear relationship between the brightness sum and the voltage difference average value.

Figure 4:
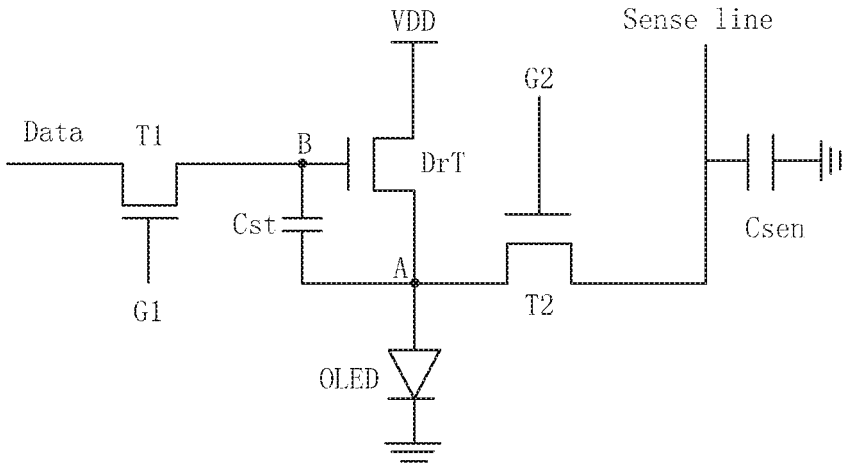
FIG. 4 is a schematic structural diagram of a pixel external compensation driving circuit to which the pixel driving method according to an embodiment of the present disclosure can be applied.

The display device includes a display panel and a pixel driving device, and each step in this embodiment may be performed by the pixel driving device. The display panel includes a plurality of pixels, each of which includes an external driving circuit and a light emitting device coupled to the external driving circuit, and the light emitting device may be an OLED. FIG. 4 is a schematic structural diagram of a pixel external driving circuit to which the pixel driving method according to an embodiment of the present disclosure can be applied. As shown in FIG. 4, the external driving circuit includes a first switching transistor T1, a driving transistor DrT, a second switching transistor T2, a first capacitor Cst, and a second capacitor Csen. A control electrode of the first switching transistor T1 is coupled to the first gate line G, a first electrode of the first switching transistor T1 is coupled to the data line 'Data', and a second electrode of the first switching transistor T2 is coupled to the second node B. A first terminal of the first capacitor Cst is coupled to the second node B, and a second terminal of the first capacitor Cst is coupled to the first node A. A control electrode of the driving transistor DrT is coupled to the second node B, a first electrode of the driving transistor DrT is coupled to the power supply VDD, and a second electrode of the driving transistor DrT is coupled to a first terminal of the OLED. A control electrode of the second switching transistor T2 is coupled to the second gate line G2, a first electrode of the second switching transistor T2 is coupled to the first node A, and a second electrode of the second switching transistor T2 is coupled to the sense line 'Sense line'. A first terminal of the second capacitor Csen is coupled to the sense line 'Sense line', and a second terminal of the second capacitor Csen is grounded. A first terminal of the OLED is coupled to the first node A, and a second terminal of the OLED is grounded. FIG. 4 merely shows one embodiment of the structure of the external driving circuit, and in practical applications, the pixel external driving circuit may also adopt other structures, which are not listed here.

After the display panel is manufactured, the display panel may be initially inspected before leaving a factory. In the initial inspection, the sense data voltage 'Sense Data' is fixed in the non-display period such as the blanking period, and the data voltage is input to the data line 'Data' corresponding to each pixel in the display panel in the display period, so that switch is made between different frames of picture on the display panel according to different gray scales, and each pixel in different frames of picture performs display according to a set gray scale. Since there is a correspondence relationship between the gray scale and the brightness, each pixel in different frames of picture perform display according to a set brightness. In some embodiments, the display panel may display a pure color picture with different gray scales, that is, different pure color pictures are displayed on the display panel according to different gray scales. When each pixel in the display panel displays a frame of picture with a set brightness, the brightness of each pixel is recorded, and a sum of the brightnesses of all pixels in the frame of picture is calculated, so as to obtain the brightness sum of the frame of picture. Also, when each pixel in the display panel displays a picture with set brightness, voltages on the sense lines (Sense line) of part or all pixels are recorded, and an average value of all recorded sensing voltages of the pixels is calculated, the average value being the voltage difference average value of the pixels in the frame of picture. In this embodiment, different brightness sums and corresponding voltage difference average values are obtained by switching between pictures with different gray scales.

In some embodiments, the voltage difference average value is an average value of the sensing voltages of all pixels in one frame of picture. In this case, the sensing voltages of all pixels in the frame of picture may be recorded, and the average value of the sensing voltages of all pixels in the frame of picture may be calculated, the average value being the voltage difference average value of the pixels in the frame of picture. The voltage difference average value is calculated by using the sensing voltages of all pixels of one frame of picture, so that the calculated voltage difference average value is more accurate.

In some embodiments, the voltage difference average value is an average value of the sensing voltages of the pixels of a set number of rows in one frame of picture. For example, the set number of rows is one row. In this case, the sensing voltage of each pixel of the set number of rows in the frame of picture may be recorded, and the average value of the sensing voltages of the pixels of the set number of rows in the frame of picture may be calculated, the average value being the voltage difference average value of the pixels in the frame of picture. The voltage difference average value is calculated by using the sensing voltages of part of pixels of one frame of picture, thus saving the space for storing the sensing voltage and improving the speed for calculating the voltage difference average value.

In step 202, a third correspondence relationship is established, the third correspondence relationship including a one-to-one correspondence relationship between the voltage difference average value of the pixels in a frame of picture and the data voltage compensation value. That is, in the third correspondence, the voltage difference average value in a frame of picture is associated with the data voltage compensation value in the frame of picture. Here, the data voltage compensation value may be a data voltage compensation value for all pixels in the frame of picture.

In the process of switching between different pictures according to different gray scales on the display panel, for each frame of picture, after recording and calculating the voltage difference average value of the pixels in the frame of picture, a data voltage compensation value is set for the data voltage of the pixels in the frame of picture and the data voltage compensation value is adjusted, and the data voltage is compensated according to the data voltage compensation value until no mura appears when human eyes watch the displayed frame of picture, and the data voltage compensation value at this moment is the data voltage compensation value associated with the voltage difference average value of the pixels in the frame of picture. The data voltage compensation values are recorded for respective frames of picture with different gray scales, thereby establishing the one-to-one correspondence relationship between the voltage difference average value and the data voltage compensation value.

Figure 5:
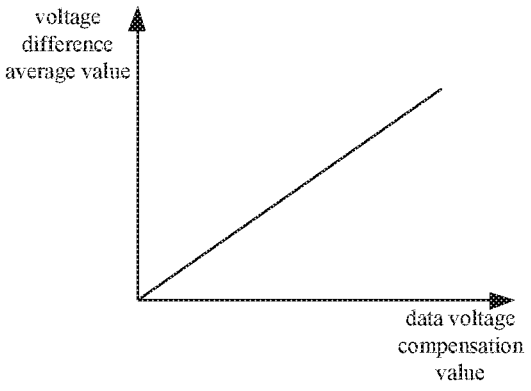
FIG. 5 is a diagram illustrating a third correspondence relationship in the method of FIG. 2.

In some embodiments, the third correspondence relationship may be implemented as a third LUT. FIG. 5 is a diagram illustrating the third correspondence relationship. As shown in FIG. 5, the abscissa represents the data voltage compensation value, the ordinate represents the voltage difference average value, and each point on the curve shows the correspondence relationship between one voltage difference average value and one data voltage compensation value associated therewith. It can be seen that there is a linear relationship between the voltage difference average value and the data voltage compensation value.

In step 203, the first correspondence relationship is generated according to the second correspondence relationship and the third correspondence relationship.

In some embodiments, the second correspondence relationship includes the one-to-one correspondence relationship between the brightness sum of a frame of picture and the voltage difference average value of the pixels in the frame of picture, and the third correspondence relationship includes the one-to-one correspondence relationship between the voltage difference average value of the pixels in a frame of picture and the data voltage compensation value, so that the brightness sum of one frame of picture can correspond to the data voltage compensation value via the voltage difference average value of the pixels in the frame of picture, thereby forming the first correspondence relationship that includes a one-to-one correspondence relationship between the brightness sum of a frame of picture and the data voltage compensation value.

Figure 6:
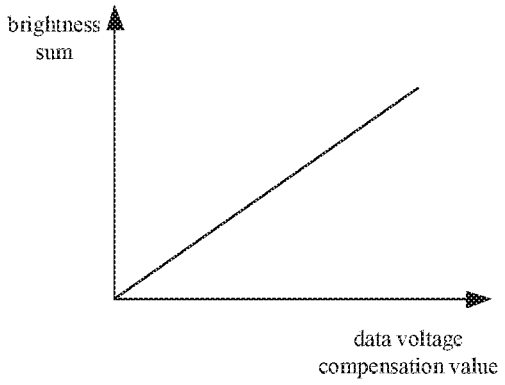
FIG. 6 is a schematic diagram of a first correspondence relationship in the method according to an embodiment of the present disclosure.

In some embodiments, the first correspondence relationship may be implemented as a first LUT. FIG. 6 is a diagram illustrating a first correspondence relationship. As shown in FIG. 6, the abscissa represents the data voltage compensation value, the ordinate represents the brightness sum, and each point on the curve shows a correspondence relationship between one brightness sum and one data voltage compensation value associated therewith. It can be seen that there is a linear relationship between the brightness sum and the data voltage compensation value.

At this point, the process of establishing the first correspondence relationship is completed. The established first correspondence relationship may be stored in a predetermined memory.

In step 204, the brightness of each pixel in one frame of picture is generated according to the data voltage of the pixel.

When the display panel performs display, the brightness of each pixel of the display panel may be calculated according to the data voltage to be input to the display panel, so as to realize the subsequent compensation of the data voltage.

In some embodiments, since there is a correspondence relationship between the data voltage and the brightness, a relational expression (or a relational curve) between the brightness and the data voltage may be set in advance. Then, the brightness of each pixel may be calculated according to the data voltage of each pixel in a frame of picture through the relational expression (or the relational curve) of the brightness and the data voltage.

In step 205, the brightness sum of a frame of picture is obtained according to the brightness of each pixel in the frame of picture.

In some embodiments, the brightnesses of all pixels in a frame of picture may be added together to obtain the brightness sum of the frame of picture.

In step 206, a data voltage compensation value corresponding to the brightness sum calculated in step 205 is inquired from the first correspondence relationship obtained in step 203, the first correspondence relationship including a one-to-one correspondence relationship between the brightness sum of a frame of picture and the data voltage compensation value.

In step 207, the data voltage is compensated according to the data voltage compensation value obtained in step 206 to generate a compensated data voltage.

In some embodiments, the data voltage in step 204 and the data voltage compensation value obtained in step 206 may be added to obtain the compensated data voltage.

In some embodiments, the data voltages of the pixels in the sensing row of the frame of picture may be compensated according to the data compensation voltage value. That is, the data voltages of the pixels in the sensing row of the frame of picture and the data voltage compensation value are added to obtain the compensated data voltages of the pixels in the sensing row of the frame of picture.

In some embodiments, the data voltages of all pixels in a frame of picture may be compensated according to the data compensation voltage value. That is, the data voltages of all the pixels of the frame of picture and the data voltage compensation value are added to obtain the compensated data voltages of all the pixels of the frame of picture.

In step 208, the compensated data voltage is output to the display panel.

In some embodiments, the compensated data voltage is output to the pixels in the sensing row of the display panel, and the pixels in the sensing row perform display according to the compensated data voltage.

In some embodiments, the compensated data voltage is output to all pixels of the display panel, and the pixels perform display according to the compensated data voltage.

In the pixel driving method according to the embodiments of the present disclosure, the data voltage compensation value corresponding to a brightness sum of a frame of picture is inquired according to the brightness sum, the data voltage is compensated according to the data voltage compensation value to generate a compensated data voltage, and the compensated data voltage is output to the display panel. According to the embodiments of the present disclosure, the sensing voltages are uniform under the driving of the compensated data voltage, thereby avoiding the mura on the displayed picture.

Figure 7:
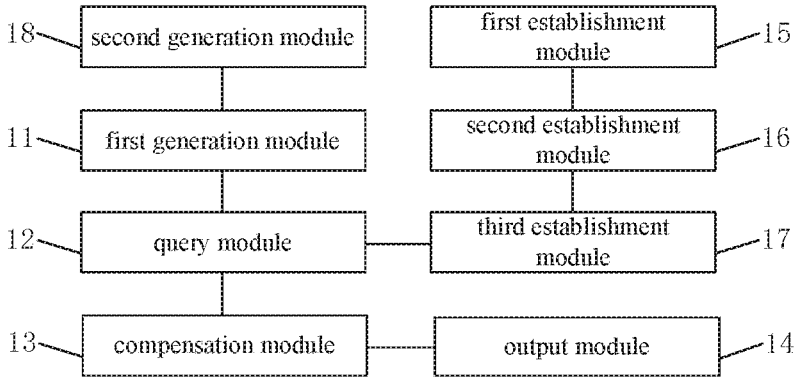
FIG. 7 is a schematic structural diagram of a pixel driving device according to an embodiment of the present disclosure.

FIG. 7 is a schematic structural diagram of a pixel driving device according to an embodiment of the present disclosure. As shown in FIG. 7, the device includes a first generation module 11, a query module 12, a compensation module 13 and an output module 14.

The first generation module 11 is configured to obtain a brightness sum of a frame of picture according to the brightness of each pixel in the frame of picture. The query module 12 is configured to inquiry a data voltage compensation value corresponding to the brightness sum from a first correspondence relationship, the first correspondence relationship including a one-to-one correspondence relationship between the brightness sum of a frame of picture and the data voltage compensation value of the frame of picture. The compensation module 13 is configured to compensate the data voltage according to the data voltage compensation value to generate a compensated data voltage. The output module 14 is configured to output the compensated data voltage to the display panel.

The device further includes a first establishment module 15, a second establishment module 16 and a third establishment module 17. The first establishment module 15 is configured to establish a second correspondence relationship including a one-to-one correspondence relationship between a brightness sum of a frame of picture and a voltage difference average value of pixels in the frame of picture. The second establishment module 16 is configured to establish a third correspondence relationship including a one-to-one correspondence relationship between the voltage difference average value of the pixels in a frame of picture and the data voltage compensation value. The third establishment module 17 is configured to generate the first correspondence relationship according to the second correspondence relationship and the third correspondence relationship.

In this embodiment, the voltage difference average value is an average value of sensing voltages of all pixels in a frame of picture; alternatively, the voltage difference average value is an average value of the sensing voltages of the pixels in a set number of rows of a frame of picture.

The device further includes a second generation module 18. The second generation module 18 is configured to generate the brightness of each pixel according to the data voltage of each pixel in a frame of picture.

The pixel driving device according to an embodiment of the present disclosure can be used for realizing the pixel driving method according to the above embodiment(s).

It should be noted that the pixel driving device may be implemented as a memory and a processor coupled to each other, and the memory stores computer-executable instructions for causing the processor to execute the steps of the pixel driving method according to the embodiments of the present disclosure. For example, the computer-executable instructions may cause the processor to realize the function of one or more of the first generation module 11, the query module 12, the compensation module 13, the output module 14, the first establishment module 15, the second establishment module 16, the third establishment module 17, and the second generation module 18 described above. The computer-executable instructions allow the functions of the modules implemented by the processor to be combined in any manner, as long as they are not mutually exclusive or contradictory.

Examples of a suitable memory include, but are not limited to: a magnetic disk or tape, an optical storage medium such as a compact disc (CD) or a digital versatile disc (DVD), a flash memory, and other non-transitory media. In some embodiments, the memory is a non-transitory memory.

It should be noted that the pixel driving device according to the present disclosure is not limited thereto, and may be implemented in other forms of combining software with hardware.

In the pixel driving device according to the embodiments of the present disclosure, the data voltage compensation value corresponding to the brightness sum of a frame of picture is inquired according to the brightness sum, the data voltage is compensated according to the data voltage compensation value to generate a compensated data voltage, and the compensated data voltage is output to the display panel. According to the embodiments of the present disclosure, the sensing voltages are uniform under the driving of the data voltage, thereby avoiding the mura on the displayed picture.

In another aspect, the embodiments of the present disclosure provide a display device including a display panel and a pixel driving device. The pixel driving device may be the pixel driving device according to the above embodiment(s), which is not repeatedly described here.

In the display device according to the embodiments of the present disclosure, the data voltage compensation value corresponding to the brightness sum of a frame of picture is inquired according to the brightness sum, the data voltage is compensated according to the data voltage compensation value to generate a compensated data voltage, and the compensated data voltage is output to the display panel. According to the embodiment of the present disclosure, the sensing voltages are uniform under the driving of the compensated data voltage, thereby avoiding the mura on the displayed picture.

It can be understood that the foregoing embodiments are merely exemplary embodiments used for describing the principle of the present disclosure, but the present disclosure is not limited thereto. Those of ordinary skill in the art may make various variations and improvements without departing from the spirit and essence of the present invention, and these variations and improvements shall also fall into the protection scope of the present disclosure.

What is claimed is:

1. A pixel driving method, comprising steps of:

obtaining a brightness sum of a frame of picture according to a brightness of each of pixels in the frame of picture, the brightness sum being a sum of brightnesses of all the pixels in the frame of picture;

inquiring a data voltage compensation value corresponding to the obtained brightness sum from a first correspondence relationship, the first correspondence relationship comprising a one-to-one correspondence relationship between the brightness sum and the data voltage compensation value for one frame of picture;

compensating a data voltage of the frame of picture according to the data voltage compensation value to generate a compensated data voltage; and outputting the compensated data voltage to a display panel, wherein before the step of obtaining a brightness sum of a frame of picture according to a brightness of each of pixels in the frame of picture, the method further comprises steps of:

establishing a second correspondence relationship, the second correspondence relationship comprising a one-to-one correspondence relationship between the brightness sum and a voltage difference average value of pixels for one frame of picture, and the voltage difference average value being an average value of sensing voltages of all or a part of the pixels in the one frame of picture;

establishing a third correspondence relationship, the third correspondence relationship comprising a one-to-one correspondence relationship between the voltage difference average value of pixels and the data voltage compensation value for one frame of picture; and generating the first correspondence relationship according to the second correspondence relationship and the third correspondence relationship.

2. The pixel driving method of claim 1, wherein the average value of the sensing voltages of the part of the pixels for one frame of picture is an average value of the sensing voltages of the pixels in a set number of rows in the one frame of picture.

3. The pixel driving method of claim 1, wherein before the step of obtaining a brightness sum of a frame of picture according to a brightness of each of pixels in the frame of picture, the method further comprises a step of:

generating the brightness of each of the pixels in the frame of picture according to a data voltage of the pixel.

4. The pixel driving method of claim 1, wherein the step of compensating a data voltage of the frame of picture according to the data voltage compensation value to generate a compensated data voltage comprises:

compensating the data voltage of the pixels in a sensing row of the frame of picture according to the data voltage compensation value, and the step of outputting the compensated data voltage to a display panel comprises:

outputting the compensated data voltage to the pixels in the sensing row of the display panel.

5. The pixel driving method of claim 1, wherein the step of compensating a data voltage of the frame of picture according to the data voltage compensation value to generate a compensated data voltage comprises:

compensating the data voltage of all the pixels in the frame of picture according to the data voltage compensation value, and the step of outputting the compensated data voltage to a display panel comprises:

outputting the compensated data voltage to all the pixels in the display panel.

6. A pixel driving device, comprising:

a memory; and a processor coupled to the memory, wherein the memory stores computer-executable instructions for causing the processor to:

obtain a brightness sum of a frame of picture according to a brightness of each of pixels in the frame of picture, the brightness sum being a sum of brightnesses of all the pixels in the frame of picture;

inquire a data voltage compensation value corresponding to the obtained brightness sum from a first correspondence relationship, the first correspondence relationship comprising a one-to-one correspondence relationship between the brightness sum and the data voltage compensation value for one frame of picture;

compensate a data voltage of the frame of picture according to the data voltage compensation value to generate a compensated data voltage; and output the compensated data voltage to a display panel, wherein the computer-executable instructions cause the processor to:

establish a second correspondence relationship, the second correspondence relationship comprising a one-to-one correspondence relationship between the brightness sum and a voltage difference average value of pixels for one frame of picture, and the voltage difference average value being an average value of sensing voltages of all or a part of the pixels for one frame of picture;

establish a third correspondence relationship, the third correspondence relationship comprising a one-to-one correspondence relationship between the voltage difference average value of the pixels and the data voltage compensation value for one frame of picture; and generate the first correspondence relationship according to the second correspondence relationship and the third correspondence relationship.

7. The pixel driving device of claim 6, wherein the average value of the sensing voltages of the part of the pixels for one frame of picture is an average value of the sensing voltages of the pixels in a set number of rows in the one frame of picture.

8. A display device, comprising a display panel and the pixel driving device of claim 7.

9. The pixel driving device of claim 6, wherein the computer-executable instructions cause the processor to:

generate the brightness of each of the pixels in the frame of picture according to a data voltage of the pixel, before obtaining the brightness sum of the frame of picture according to the brightness of each of pixels in the frame of picture.

10. A display device, comprising a display panel and the pixel driving device of claim 9.

11. A display device, comprising a display panel and the pixel driving device of claim 6.

12. The pixel driving device of claim 6, wherein the computer-executable instructions cause the processor to:

compensate the data voltage of the pixels in a sensing row of the frame of picture according to the data voltage compensation value, and output the compensated data voltage to the pixels in the sensing row of the display panel.

13. The pixel driving device of claim 6, wherein the computer-executable instructions cause the processor to:

compensate the data voltage of all the pixels in the frame of picture according to the data voltage compensation value, and output the compensated data voltage to all the pixels in the display panel.

* * * * *